US006287053B1

(12) United States Patent
Garofalo et al.

(10) Patent No.: US 6,287,053 B1
(45) Date of Patent: Sep. 11, 2001

(54) EQUIPPED BALANCING JACKET

(75) Inventors: Giovanni Garofalo, Rapallo; Alberto Belloni, Recco; Gabriele Canella, Rapallo, all of (IT)

(73) Assignee: HTM Sport S.p.A. (IT)

( * ) Notice: Subject to any disclaimer, the term of this patent is extended or adjusted under 35 U.S.C. 154(b) by 0 days.

(21) Appl. No.: 09/255,784

(22) Filed: Feb. 23, 1999

(30) Foreign Application Priority Data

Mar. 27, 1998 (IT) ..... GE98A0021

(51) Int. Cl.[7] ..... B63C 11/02
(52) U.S. Cl. ..... 405/186; 441/96
(58) Field of Search ..... 405/186, 185; 441/96, 90, 92, 106, 114; 128/202.14

(56) References Cited

U.S. PATENT DOCUMENTS

| | | | | |
|---|---|---|---|---|
| 3,519,021 | * | 7/1970 | Wiswell | 405/186 X |
| 3,727,250 | * | 4/1973 | Koehn et al. | 405/186 |
| 3,820,348 | * | 6/1974 | Fast | 405/186 |
| 3,866,253 | * | 2/1975 | Sinks et al. | 405/186 |
| 4,000,534 | * | 1/1977 | Cerniway et al. | 405/186 |
| 4,009,583 | | 3/1977 | Buckle . | |
| 4,051,846 | * | 10/1977 | McClure, III | 128/202.14 |
| 4,054,132 | * | 10/1977 | Deeds | 128/202.14 |
| 4,108,171 | * | 8/1978 | Nyman et al. | 128/202.14 |
| 4,114,389 | * | 9/1978 | Bohmrich et al. | 405/186 |
| 4,137,585 | | 2/1979 | Wright, III . | |
| 4,176,418 | * | 12/1979 | Scott | 441/96 |
| 4,523,914 | * | 6/1985 | Faulconer et al. | 441/106 X |
| 4,779,554 | | 10/1988 | Courtney . | |
| 4,913,589 | * | 4/1990 | Faulconer et al. | 405/186 |
| 4,964,404 | * | 10/1990 | Stone | 128/204.22 |
| 5,074,714 | * | 12/1991 | Franco | 405/186 |
| 5,385,496 | * | 1/1995 | Seligman | 405/186 X |
| 5,482,405 | * | 1/1996 | Tolksdorf et al. | 405/186 |
| 5,560,738 | | 10/1996 | Noel . | |
| 5,570,688 | * | 11/1996 | Cochran et al. | 128/205.23 |
| 5,620,282 | | 4/1997 | Stinton . | |
| 5,660,503 | | 8/1997 | Lewis . | |
| 5,678,542 | * | 10/1997 | Maffatone | 405/186 X |
| 5,707,177 | * | 1/1998 | Lehrer et al. | 405/186 |
| 5,902,073 | * | 5/1999 | Eungard et al. | 405/186 X |
| 6,217,257 | * | 4/2001 | Garofalo et al. | 405/186 |

FOREIGN PATENT DOCUMENTS

| | | |
|---|---|---|
| 1 035 510 | 7/1958 | (DE) . |
| 633 421 | 1/1928 | (FR) . |
| 1 272 744 | 10/1960 | (FR) . |
| 2 298 141 | 8/1996 | (GB) . |

* cited by examiner

*Primary Examiner*—David Bagnell
*Assistant Examiner*—Jong-Suk Lee
(74) *Attorney, Agent, or Firm*—Larson & Taylor, PLC

(57) ABSTRACT

An equipped balancing jacket includes a stiff back containing a first stage reducer connected by lines to a high and low pressure distributor connected to various equipment. The jacket further includes pneumatic exhaust valves, a manual emergency control and a mouth inflation devcie.

8 Claims, 4 Drawing Sheets

EQUIPPED BALANCING JACKET

BACKGROUND AND SUMMARY OF THE INVENTION

The present invention refers to a balancing jacket for divers.

Divers who love to dive for long times are constrained to carry, besides tanks, a series of lines or hoses connecting the tanks to the different equipment, emergency supply, and so on. All these lines can cause some nuisances and difficulties to the user since they can become entangled with some obstacles or with each other, thereby compromising their functionality and the user's safety. These and other problems, such as, for instance, the recharge and the quick exhaust of the balancing jacket air are solved by the present invention.

In fact, the balancing jacket according to the invention is equipped for containing all the lines within, moreover it includes upper and lower pneumatic exhaust valves. The jacket back consists of a container in which, according to an operative form of the present invention, are inserted the lines coming from the first reduction stage connected to the tank and a first high and low pressure distributor. According to a second operative form of the invention, the first reduction stage is positioned in the container and; connected with a first high and low pressure distributor, being the tank connected with the first stage by a simple window. From the distributor the lines enter the balancing jacket and go towards: the pressure gauge or the check computer, the control system and the second distributor. From these system start the connections to the functions: from the control system to the balancing jacket and the watertight wetsuit, from the second distributor to the second stage and the emergency supplier.

By using an equipped balancing jacket according to the invention, the connection between the bottle and the first stage reducer and/or the first distributor is protected by the back from eventual incorrect positioning or tears, the diver has all the controls and functions within reach without having "roaming" lines, easily sets his position in the water due to the exhaust valves which allow him to take any position he wants, moreover, due to the computer, he can check for instance the air pressure in the tanks, at which depth he is and other data.

BRIEF DESCRIPTION OF THE DRAWINGS

The invention will be now better described with reference to the enclosed drawings, where.

DESCRIPTION OF THE PREFERRED EMBODIMENTS OF THE INVENTION

Figure 1:
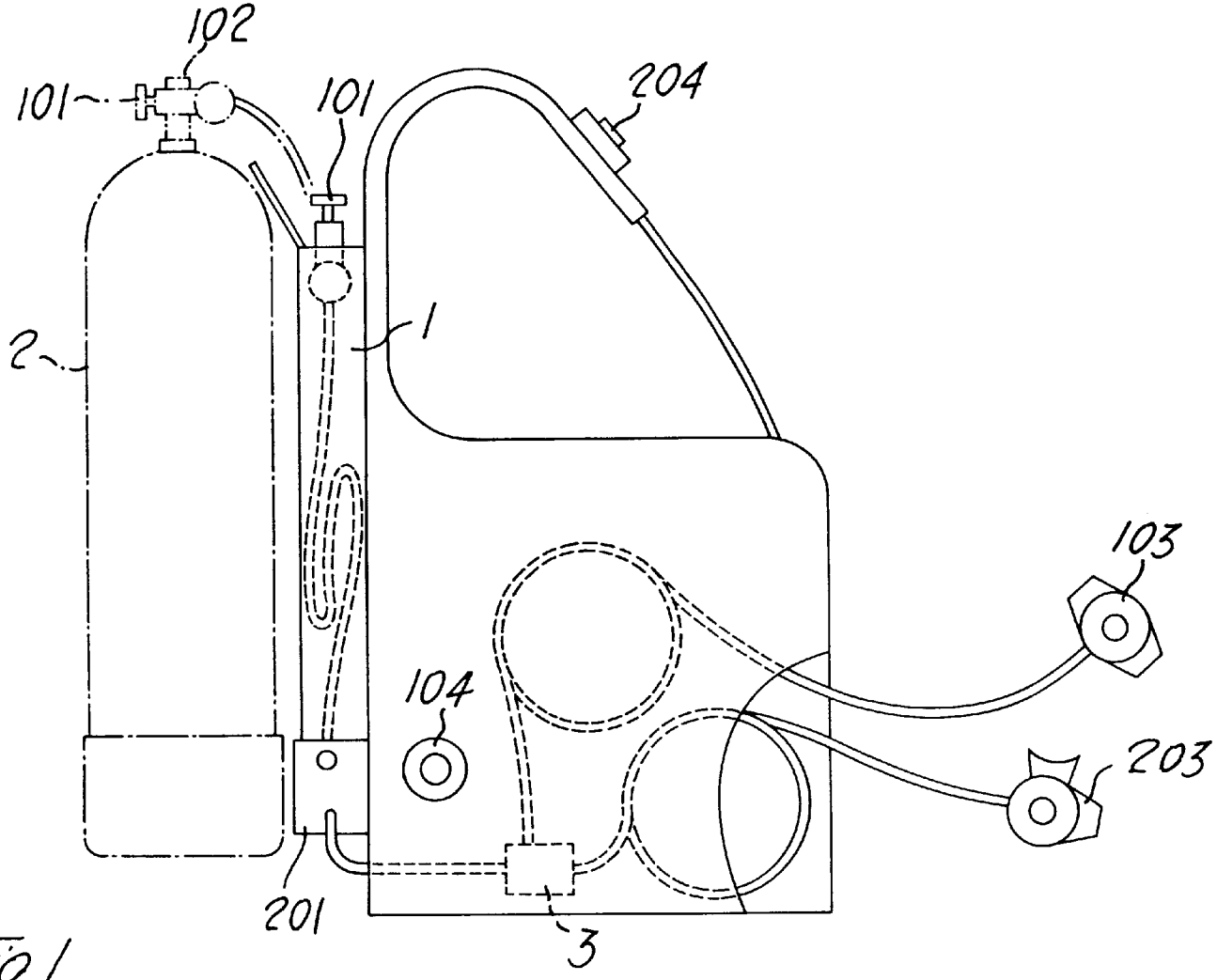
FIG. 1 is a side elevational view of an operative form of the equipped balancing jacket according to the present invention.
Figure 2:
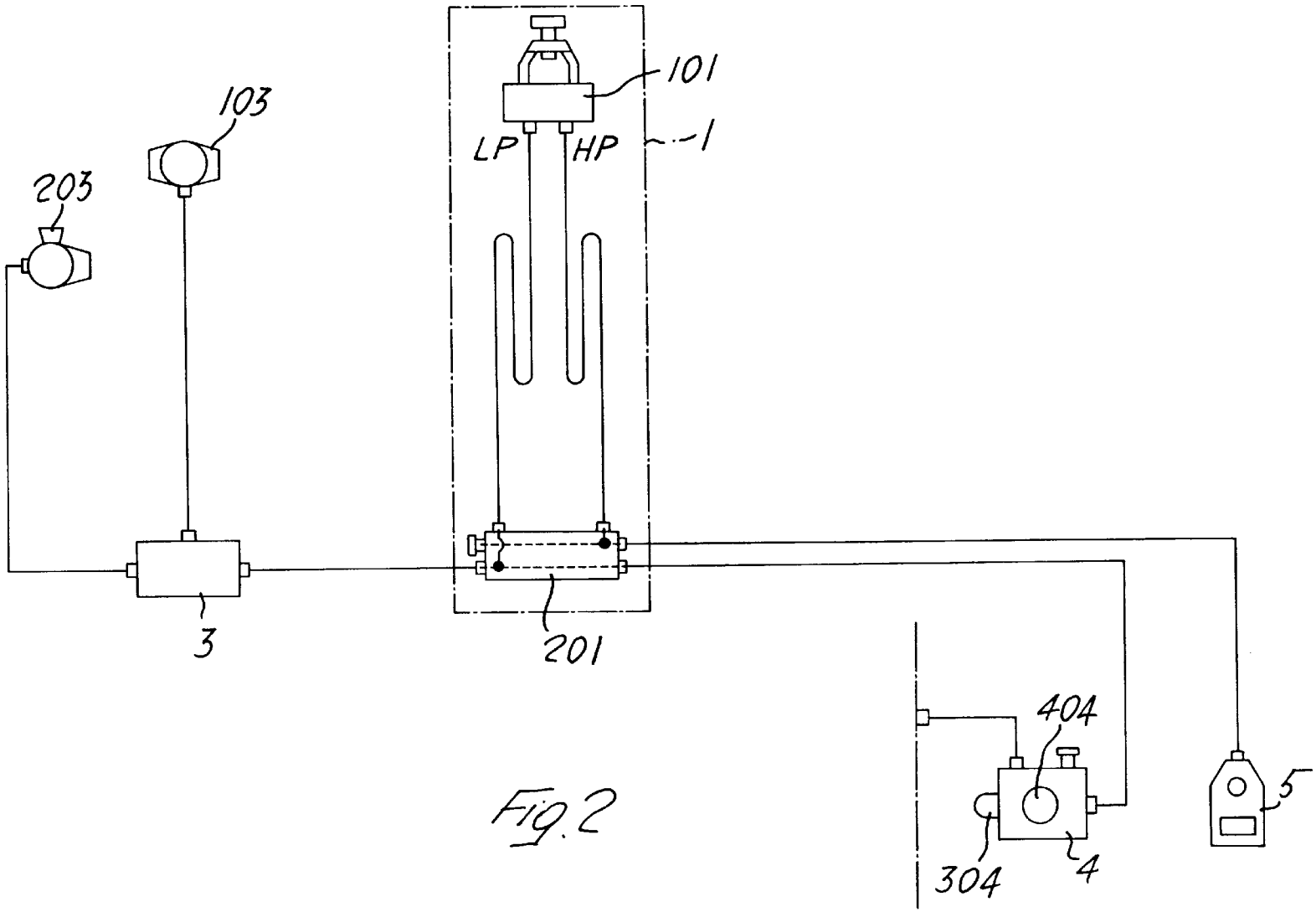
FIG. 2 is a first operative form of an air circulation system in schematic form.

The balancing jacket of FIG. 1 consist of a stiff back 1 and a part of textile material similar to the jacket on the market. In the upper part of the back 1 is the first stage reducer 101 connected with the valve 102 of the tank 2. In the lower part of the back 1 is the first distributor 201, which is an high (HP) and low (LP) pressure distributor. The jacket includes a second distributor 3 directing the air to the second stage regulator 103 or the second emergency stage regulator 203. On the jacket it can be seen the lower 104 and upper 204 exhaust valves. In the diagram of FIG. 2 it can be noticed that the first distributor 201 is connected also with a control system 4 provided with charge 304 and exhaust 404 push-button and with a pressure gauge or a computer 5 by an high pressure line.

Figure 3:
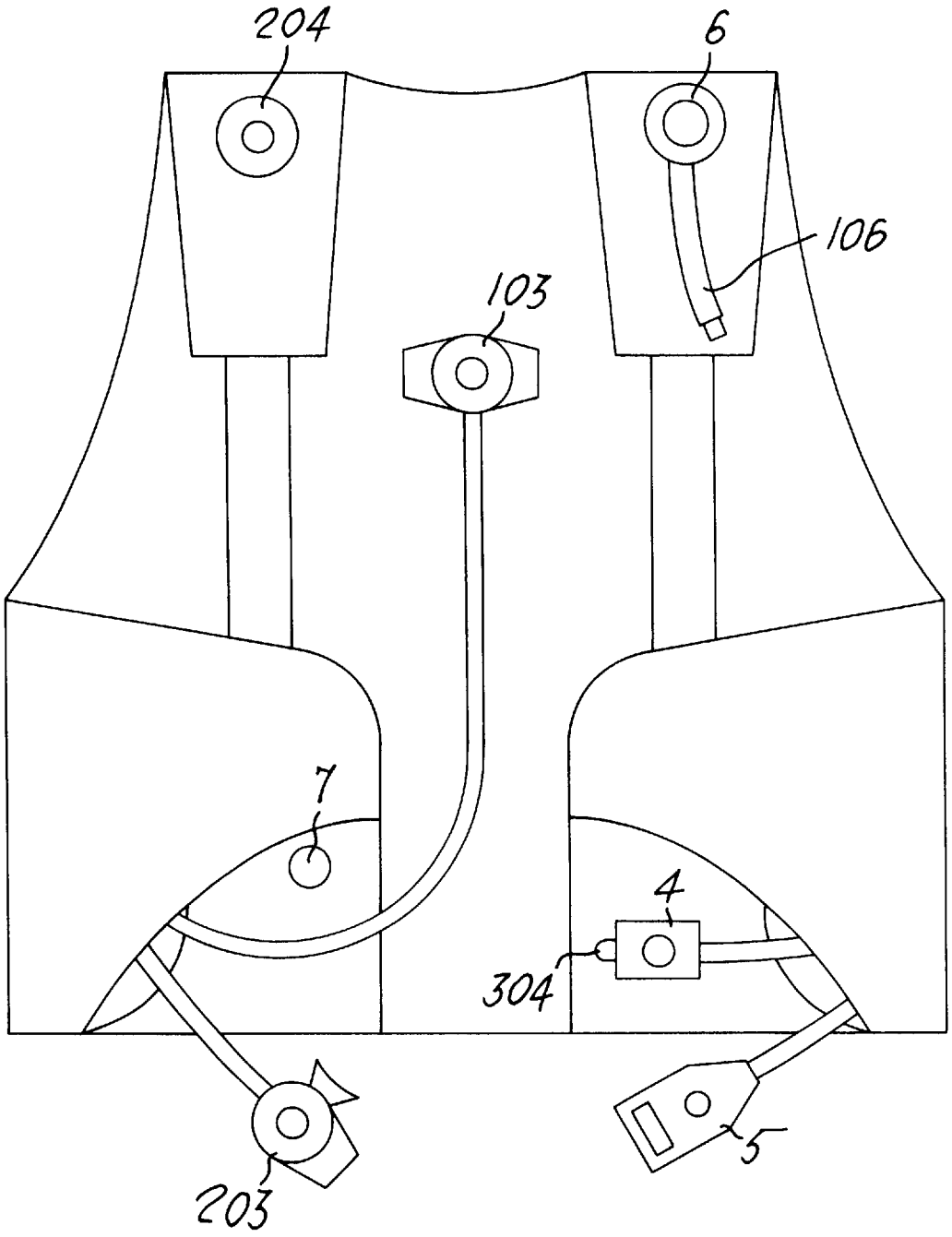
FIG. 3 is a side elevational view of the jacket of FIG. 1.

In FIG. 3 it can be seen the second stage 103, the second emergency stage 203, the control system 4, the computer 5 coming out of the balancing jacket. On the jacket shoulder it can be seen: the upper exhaust pneumatic valve 204, the emergency manual control 6 and the mouth inflation 106, moreover there is the plug 7.

Figure 4:
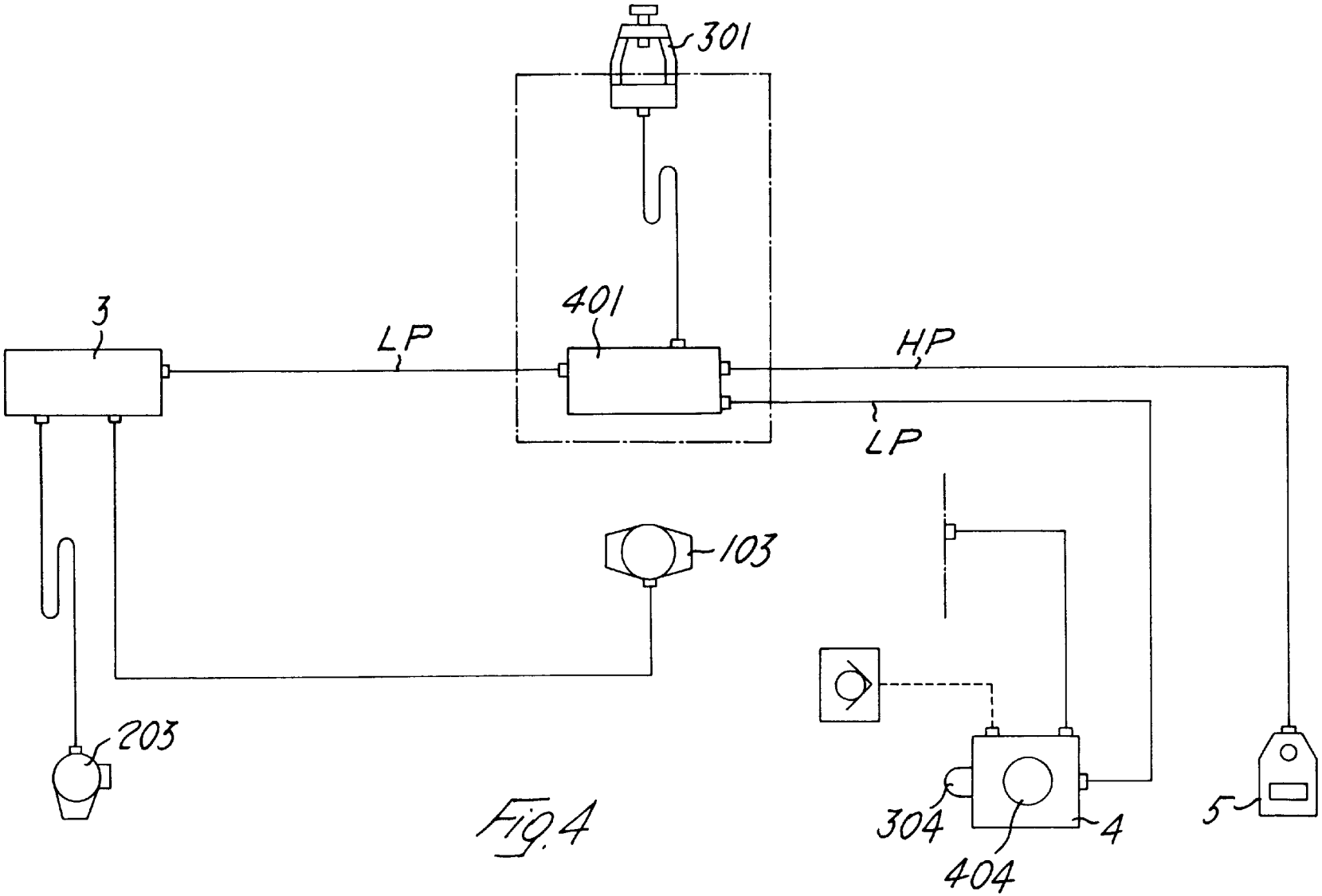
FIG. 4 is a second operative form of air circulation system in schematic form.

In FIG. 4 shows an alternative embodiment to the one described in FIG. 2. To like numbers correspond like parts. According to this operative form, the first stage 401 is housed in the jacket back container, and is connected to the tanks by a line ending up at the bracket 301. The first stage 401 is connected with a distributor including one or more low pressure exits and at least one high pressure exit.

The following describes the functioning of the line connecting system between tank and user, made by means of the back, according to the invention.

In the first embodiment of FIGS. 1 to 3, the air coming out of the tank valve 102 goes into the first stage 101, one part goes out at low pressure (LP), one part passes isobarically (HP). The two lines, by passing within the back 1, reach the first distributor 201.

The high pressure air directly goes to the computer pressure detector or to the pressure gauge. On the basis of the measured data the computer shows the amount of air still present in the tanks, the duration time and other data.

One part of the low pressure air passes through the second distributor 3, from which start the lines to the second stage regulator 103, it is to say to the user's supplier and to the second emergency stage regulator 203, also said Octopus. There can eventually not be the second distributor 3, in this case, evidently, the second stage regulator 103 and the Octopus 203 are directly connected with the first distributor, as shown in FIG. 3.

The other part of low pressure air goes to the control system 4.

The control system 4 allows, in case of need, filling the balancing jacket with air by pressing the push-button 304. Eventually, if the push-button 404 is present, it is possible to exhaust the air from the jacket; in such case the valve's pneumatic opening system can be of the type described in the U.S. patent application Ser. No. 09/188223 to Giovanni GAROFALO and Alberto BELLONI, filed on Nov. 9, 1998.

The second embodiment of the invention shown in FIG. 4 is different from the first one, since the balancing jacket includes the first stage 401 too, connected with an high pressure distributor, connected to the bottles by means of a line and the connecting bracket 301. The air coming out from the distributor connected with the high pressure first stage goes towards the computer 5 or the pressure gauge, the air coming out from the low pressure first stage reducer goes towards the second distributor 3 and from here towards the reduction second stage regulator 103 and the Octopus 203 or towards the control system 4. As shown, analogously to the executive form of FIG. 2, the control system 4 is also connected with the jacket exhaust valves. Moreover it can be provided for the high pressure air to be sent directly from the tank or bottles to the computer pressure detector or to the pressure gauge.

In case the user wears a watertight wetsuit, the control system 3 or 4 can be connected to the wetsuit too, thereby regulating the filling.

The push-button 6 allows manual control of the balancing jacket in emergency cases. The pipe 106 is an element for inflation of the jacket manually or by mouth.

What is claimed is:

1. An equipped balancing jacket comprising a stiff back housing, a first stage pressure reducer connected to at least one compressed air tank, said first stage pressure reducer being in turn connected by means of an intermediate pressure hose to a first distributor, said first distributor being in turn connected by lines coming out of said first distributor and passing within the jacket to a second, low pressure distributor provided with a plurality of outlets and connected to a second stage regulator.

2. The balancing jacket according to claim 1, further comprising a high pressure hose extending outwardly from said first stage pressure reducer.

3. The balancing jacket according to claim 2, wherein said high pressure hose is connected through said first distributor to a high pressure gauge.

4. The balancing jacket according to claim 2, wherein said high pressure hose is connected to a high pressure gauge.

5. The balancing jacket according to claim 1, further comprising an emergency manual control and a mouth inflation element connected thereto.

6. The balancing jacket according to claim 1, wherein said first stage pressure reducer and said first low pressure distributor are positioned in a single body.

7. The balancing jacket according to claim 1, wherein the outlets of said second stage distributor are connected to a second stage emergency regulator, and to an inflation control system controlling the inflation of the balancing jacket.

8. The balancing jacket according to claim 1, wherein the jacket includes pneumatic exhaust valves controlled by said inflation control system.

* * * * *